US005913737A

United States Patent [19]

Park

[11] Patent Number: 5,913,737

[45] Date of Patent: Jun. 22, 1999

[54] GOLF TEE SETTING DEVICE

[76] Inventor: Sun Hyo Park, 2110 E. Vista Mesa Way, Orange, Calif. 92867

[21] Appl. No.: 08/998,181

[22] Filed: Dec. 24, 1997

[51] Int. Cl.[6] ..... A63B 57/00

[52] U.S. Cl. ..... 473/386; 473/400

[58] Field of Search ..... 473/386, 387–403

[56] References Cited

U.S. PATENT DOCUMENTS

| | | | |
|---|---|---|---|
| 1,670,123 | 5/1928 | Ranseen | 473/394 |
| 2,033,269 | 3/1936 | Williams | 473/396 |
| 2,801,852 | 8/1957 | Hottle | 473/386 |
| 3,473,812 | 10/1969 | Pelzmann | 473/396 |
| 3,606,344 | 9/1971 | Ball | 473/398 |
| 3,658,331 | 4/1972 | Driscoll | 473/386 |
| 4,982,510 | 1/1991 | Musillo | 473/386 |
| 5,221,090 | 6/1993 | Hong | 473/390 |
| 5,645,500 | 7/1997 | Borden | 473/386 |
| 5,728,012 | 3/1998 | Boelling | 473/386 |

*Primary Examiner*—Steven Wong

[57] ABSTRACT

A golf tee setting device is used for adjustably positioning a golf tee into a ground surface. The golf tee setting device includes a body made of a rigid material and at least one receptacle formed in the body for partially receiving the golf tee. The receptacle is formed to have a predetermined length shorter than a length of the golf tee so that a lower end of the golf tee is exposed from the body such that the height of the golf tee with respect to the ground surface is consistent. Preferably, the receptacle is substantially perpendicular to a bottom of the body. The receptacle is configured substantially in a shape of an inverse pyramid such that the receptacle tapers from a wider top portion to a narrower lower portion. There may be two or more receptacles formed in the body, each receptacle configured to receive the golf tee. Each receptacle is configured to receive the golf tee and to have different length than the other receptacles.

7 Claims, 6 Drawing Sheets

GOLF TEE SETTING DEVICE

BACKGROUND OF THE INVENTION

1. Field of the Invention

This invention relates to an apparatus for use with golf tees, and more particularly, to an apparatus for positioning a golf tee into a ground surface to any predetermined height.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played on a course consisting typically of eighteen holes. A set of clubs is used to strike a golf ball in each hole. Each hole has a tee box which defines a starting location of that hole in which a golfer places a golf ball and swings a golf club to strike the ball towards a designated green. Before striking the golf ball, the golfer first places a tee into the ground and then places a golf ball on the convex surface of the tee.

Conventional golf tee consists of an elongated plastic or wood piece inserted into a ground surface. The positioning of the golf tee is controlled by a golfer who uses golfer's feel and eye to control the height. Sometimes the mispositioning of the golf tee can bring a dire consequence to the golfer's game.

A positioning of a golf ball on a golf tee greatly influence a golfer's game. In particular, the height of the golf tee is adjusted by a golfer depending on the wind condition or one's golfing ability. For example, for low or no wind condition, the full height of more than 1.5 inches is used to tee the golf ball at a greater height to achieve a higher flight trajectory. Conversely, for high wind condition, a lower height of less than 1 inch is used to achieve a lower flight trajectory. The lower flight trajectory allows the golf ball to travel farther with less wind resistance.

The condition of the tee box also influence greatly to golfer's game. If the length of the grass in the tee box is tall, then golfers are likely to tee of at a greater height.

SUMMARY OF THE DISCLOSURE

It is an objective of the present invention to provide a golf tee setting device which can easily insert a golf tee into a ground surface at a predetermined height.

According to a first embodiment of the present invention, a golf tee setting device is used for adjustably positioning a golf tee into a ground surface. The golf tee setting device includes a body made of a rigid material and at least one receptacle formed in the body for partially receiving the golf tee. The receptacle is formed to have a predetermined length shorter than a length of the golf tee so that a lower end of the golf tee is exposed from the body such that the height of the golf tee with respect to the ground surface is consistent. Preferably, the receptacle is substantially perpendicular to a bottom of the body.

In the first embodiment the receptacle is configured substantially in a shape of an inverse pyramid such that the receptacle tapers from a wider top portion to a narrower lower portion. It is preferably that there are two receptacles formed in the body, each receptacle configured to receive the golf tee. First and second receptacles are aligned to have the same axis, and the first receptacle may be formed immediately above the second receptacle.

The length of the first receptacle for receiving the golf tee is approximately 0.75 inches and the second receptacle is approximately 0.25 inches. Alternatively, the length of the first receptacle for receiving the golf tee may be approximately 1 inch and the second receptacle may be approximately 0.5 inches.

According to a second embodiment of the present invention, the golf tee setting device may have a plurality of receptacles formed around a cylindrical or rectangular body. Each receptacle is configured to receive the golf tee and to have different length than the other receptacles.

According to a third embodiment of the present invention, the golf tee setting device has a body made of a rigid material and a receptacle. The receptacle is formed in the body for partially receiving the golf tee. The receptacle has a bottom end and a top end both of which are exposed. The top end of the receptacle is configured to receive the golf ball. The receptacle is formed to have a predetermined length shorter than a length of the golf tee so that a lower end of the golf tee is exposed from the body such that the height of the golf tee with respect to the ground surface is consistent. Moreover, the body has a collar projecting from the rear and upwardly from the body for supporting the golf ball.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
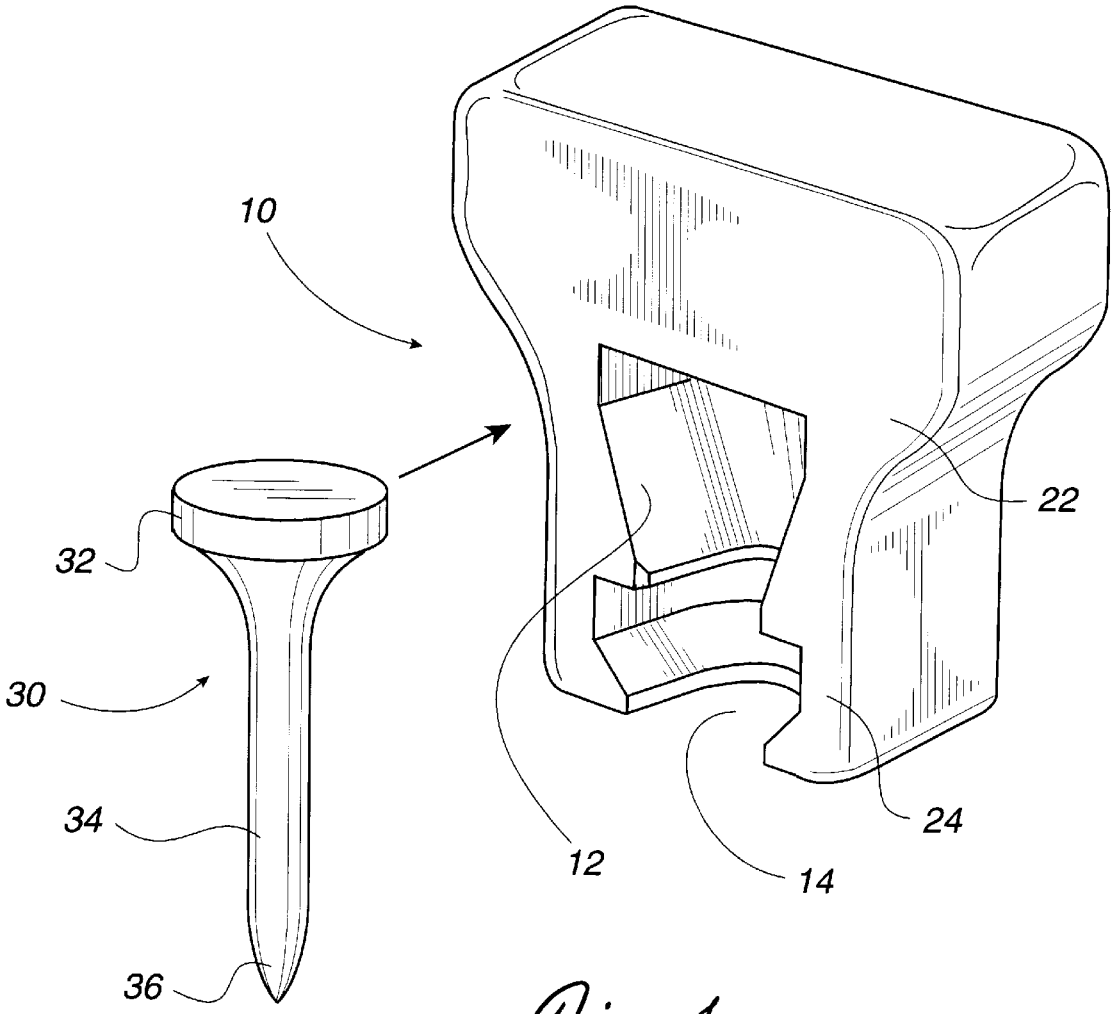
FIG. 1 illustrates a perspective view of a first embodiment of the golf tee setting device.

FIG. 1 illustrates a perspective view of the golf tee setting device 10 according to the present invention. The golf tee setting device 10 preferably has a handle 22 which is near the top portion and a body 24 having first and second receptacles 12 and 14, respectively, for receiving a golf tee 30. A golf tee is generally divided into three portions: a head portion 32; a middle portion 34; and a lower portion 36. The head portion 32 has a concavity at the top for supporting a golf ball. Each receptacle 12 or 14 is configured to the shape of the head portion 32 of the golf tee 30.

Figure 2:
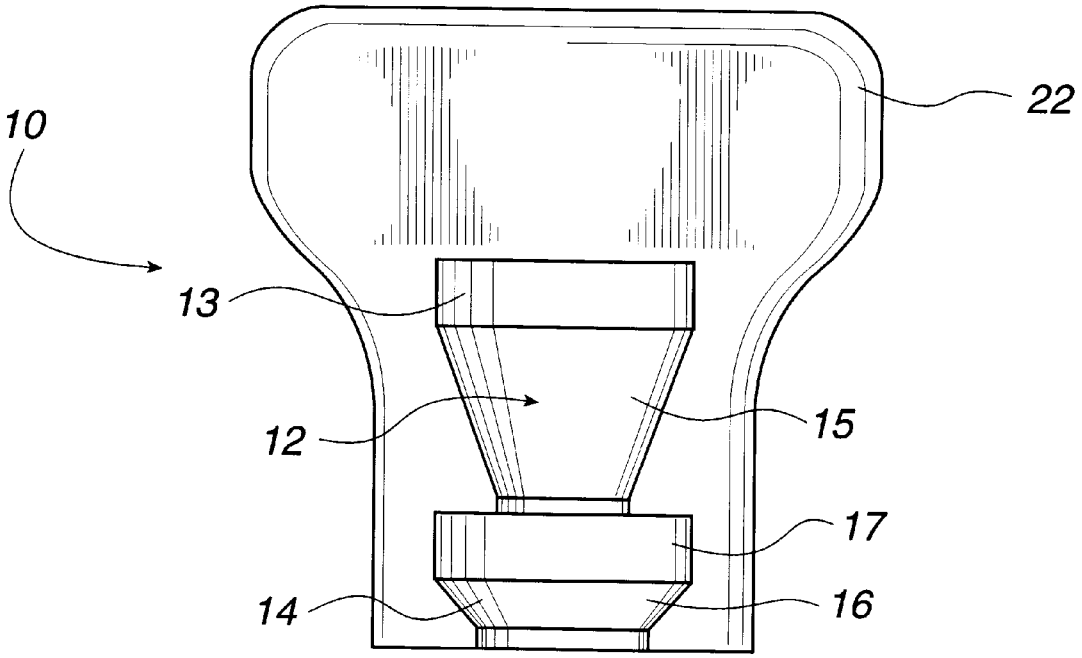
FIG. 2 illustrates a front elevation view of the golf tee setting device of FIG. 1.

FIGS. 2 to 5 illustrate the first embodiment of the present invention in detail. FIG. 2 is a front elevation view of the first embodiment. The handle 22 of the golf tee setting device 10 is slightly larger in size than the body 24 to facilitate the insertion of the golf tee into a ground surface. Preferably, the first receptacle 12 includes a semi-cylindrical aperture 13 so that its cross section is substantially a rectangle. The size of the semi-cylindrical aperture 13 is preferably slightly larger than the head portion 32 of the golf tee 30. The first receptacle 12 also includes an inverse pyramid shaped aperture 15 which is configured, but slightly larger than the tapering section of the golf tee 30 which connects the head portion 32 and the middle portion 34 of the golf tee 30. The second receptacle 14 has similar structure as the first receptacle 12, except that the inverse pyramid aperture 16 of the second receptacle 14 is substantially smaller than that of the first receptacle 12.

Figure 3:
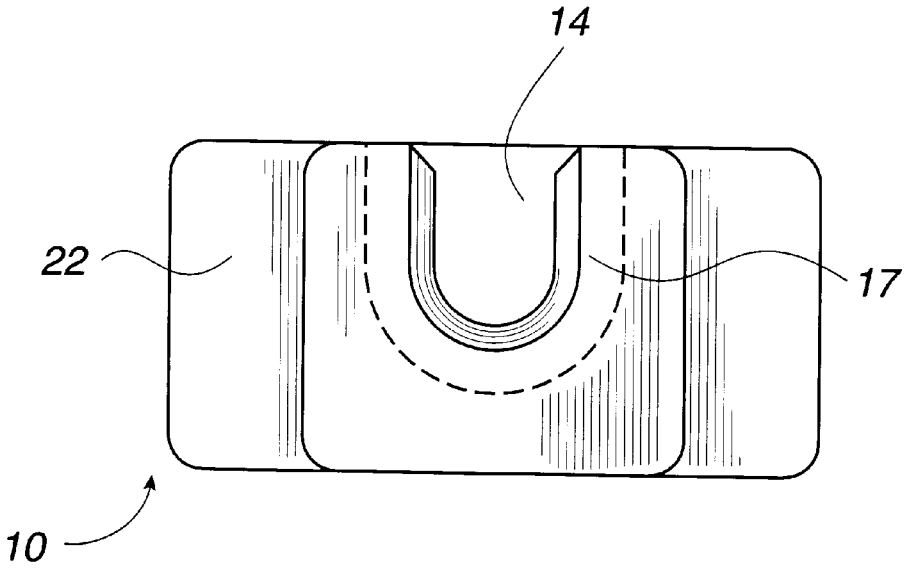
FIG. 3 illustrates a bottom plan view of the golf tee setting device of FIG. 1.
Figure 4:
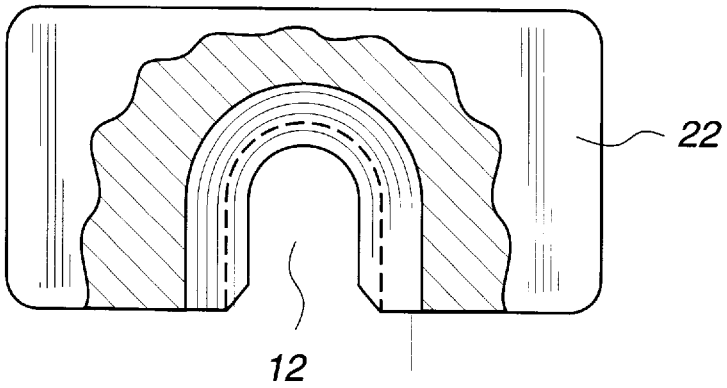
FIG. 4 illustrates a top plan view of the golf tee setting device of FIG. 1.

FIG. 3 illustrates a bottom plan view of the golf tee setting device 10, in which the second receptacle 14 is directly shown. FIG. 4 illustrates a top plan view of the golf tee setting device 10.

Figure 5:
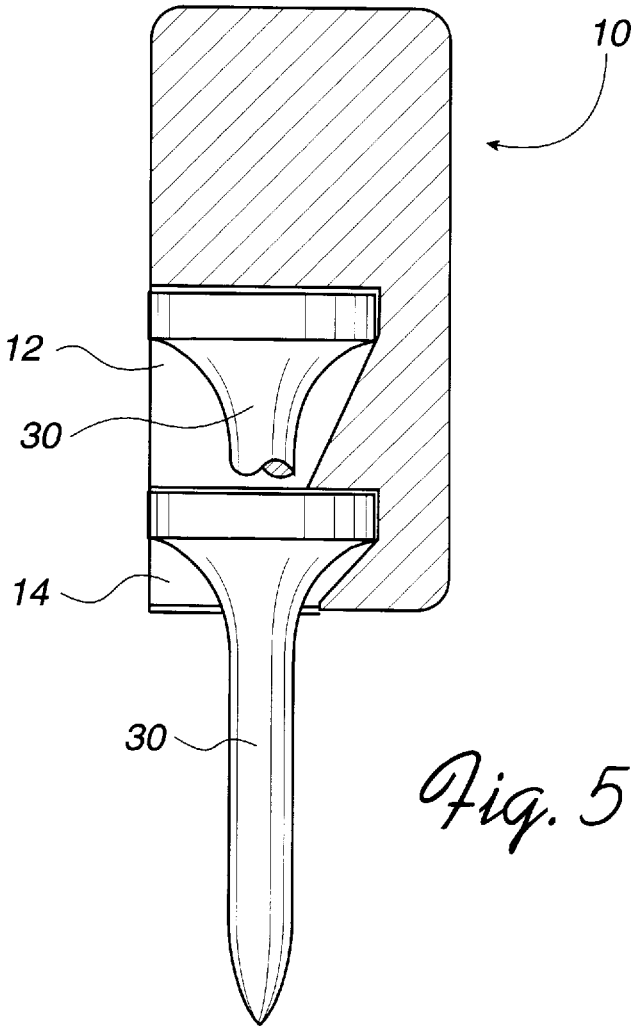
FIG. 5 illustrates a cross-sectional side elevation view of the golf tee setting device of FIG. 1.

FIG. 5 illustrates a cross-sectional elevation view of the golf tee setting device 10 with the position of the golf tee 30. As shown, the first receptacle 12 is used for a higher setting of the golf tee 30 with respect to the ground surface. The second receptacle 14 is used for a lower setting of the golf tee 30. Because of the shape of each receptacle 12 or 14, the golf tee 30 can be removably placed therein and be forced into the a ground surface at a predetermined height.

Depending on the golf condition, such as wind and condition of grass in a tee box, a golfer may select either first 12 or second receptacle 14 to tee off. The golf tee setting device 10 preferably has height dimension pre-printed on the body so that a golfer can readily determine which receptacle to use. For instance, a label of "0.75 Inches" may be printed immediately adjacent to the first receptacle 12 and a label of "0.25 Inches" may be printed immediately adjacent to the second receptacle 14.

The preferred dimensions of the golf tee setting device 10 will now be described. According to the first embodiment of the present invention, the width and height of the golf tee setting device 10 shown in FIG. 1 is each approximately 1.3 inches. the position of the first receptacle 12 with respect to the bottom of the golf tee setting device 10 is approximately 0.75 inches. The position of the second receptacle 14 is approximately 0.25 inches. Alternatively, the golf tee setting device 10 may be constructed so that the height is increased to 1.75 inches. Accordingly, the positions of the first and second receptacles 12 and 14 are respectively increased to 1.25 inches and 1 inch. It is also possible to have more than two receptacles in a golf tee setting device 10. Typically, a golfer will only need to carry one or two golf tee setting device 10 so that there are four or more variable golf tee heights available to accommodate golfer's needs.

The golf tee setting device 10 according to the present invention is made of a rigid and durable material, such as plastic, metal or glass. Because of its simple and small construction, the golf tee setting device 10 may be made of an injection molding or any other suitable manufacturing process. Moreover, a company logo, name and telephone number may be printed on the outer surface as an effective advertisement tool.

Figure 6:
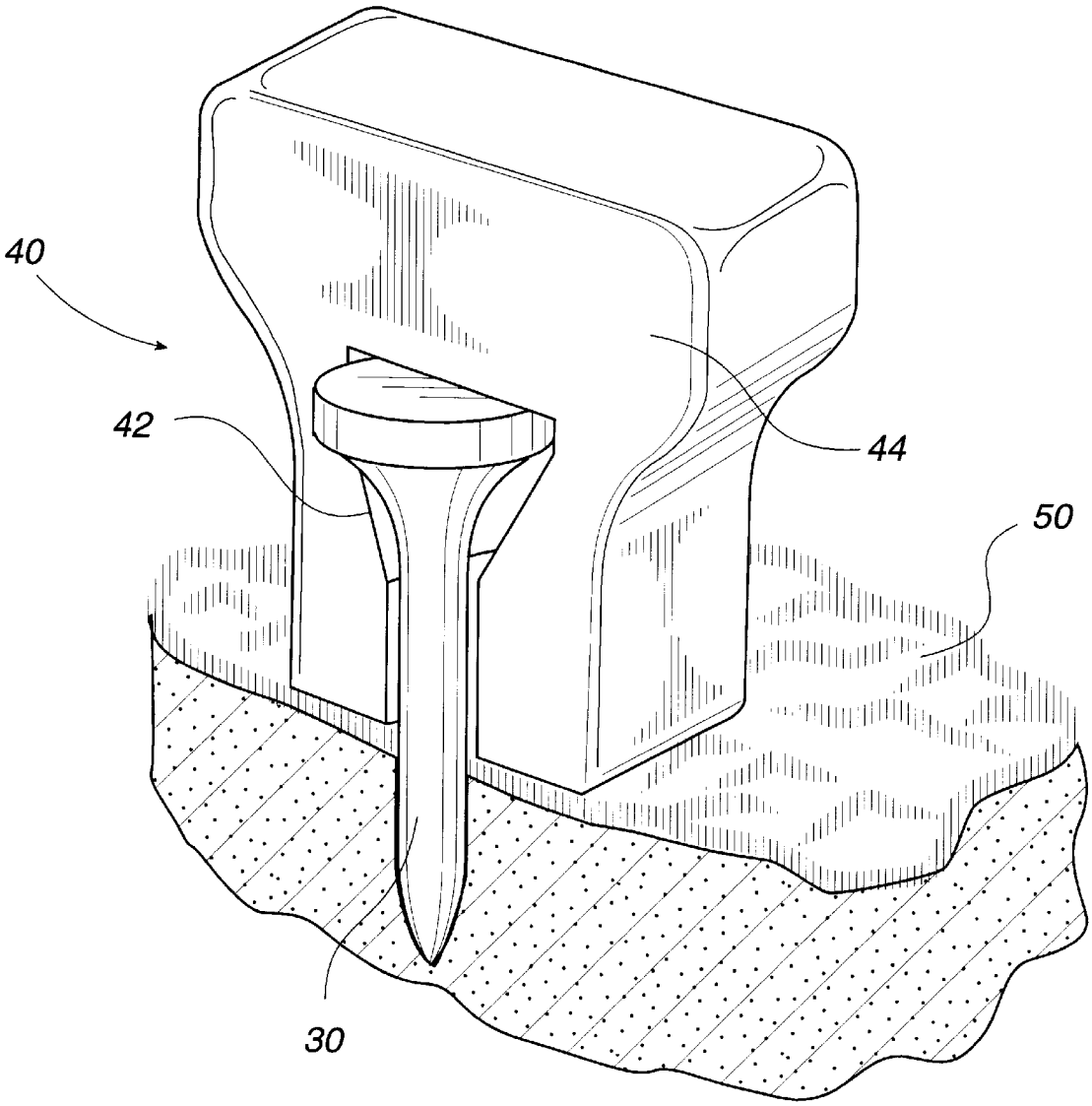
FIG. 6 illustrates a perspective view of a second embodiment of the golf tee setting device and its application.

The application of the present invention will be described with regard to FIG. 6. FIG. 6 illustrates a second embodiment of the present invention. The golf tee setting device 40 according to the second embodiment has only one receptacle 42. Such device may be used by an advanced golfer who uses a golf tee only during tee off. However, the use of the present invention, whether it has one or more receptacles is identical. First a golf tee 30 is placed into a receptacle 42. Due to the shape of the receptacle 42, the golf tee 30 will be removably placed into the receptacle 42. Then a golfer will grab the handle 44 and force the lower part of the golf tee 30 into a ground surface 50. When the lower portion of the golf tee setting device 40 abuts against the ground surface 50, the golf tee 30 is positioned substantially perpendicular to the ground surface 50 at a predetermined height. The golf tee setting device 40 is then removed by sliding it side way thus fully exposing the golf tee 30. The golf tee 30 is now ready to receive a golf ball.

As an alternative embodiment, although not illustrated in the drawings, there may be a plurality of receptacles formed not on the top of another, but adjacent to each other. For example, the golf tee setting device may take a form of a cylinder which has a receptacle formed in the body at every 90 degree angle. Alternatively, the golf tee setting device may have a rectangular or square body which has a receptacle formed on each side. As a result, there may be four receptacles of different length around the circumferential surface of the cylinder, each receptacle being used for a different golfing condition.

Figure 7:
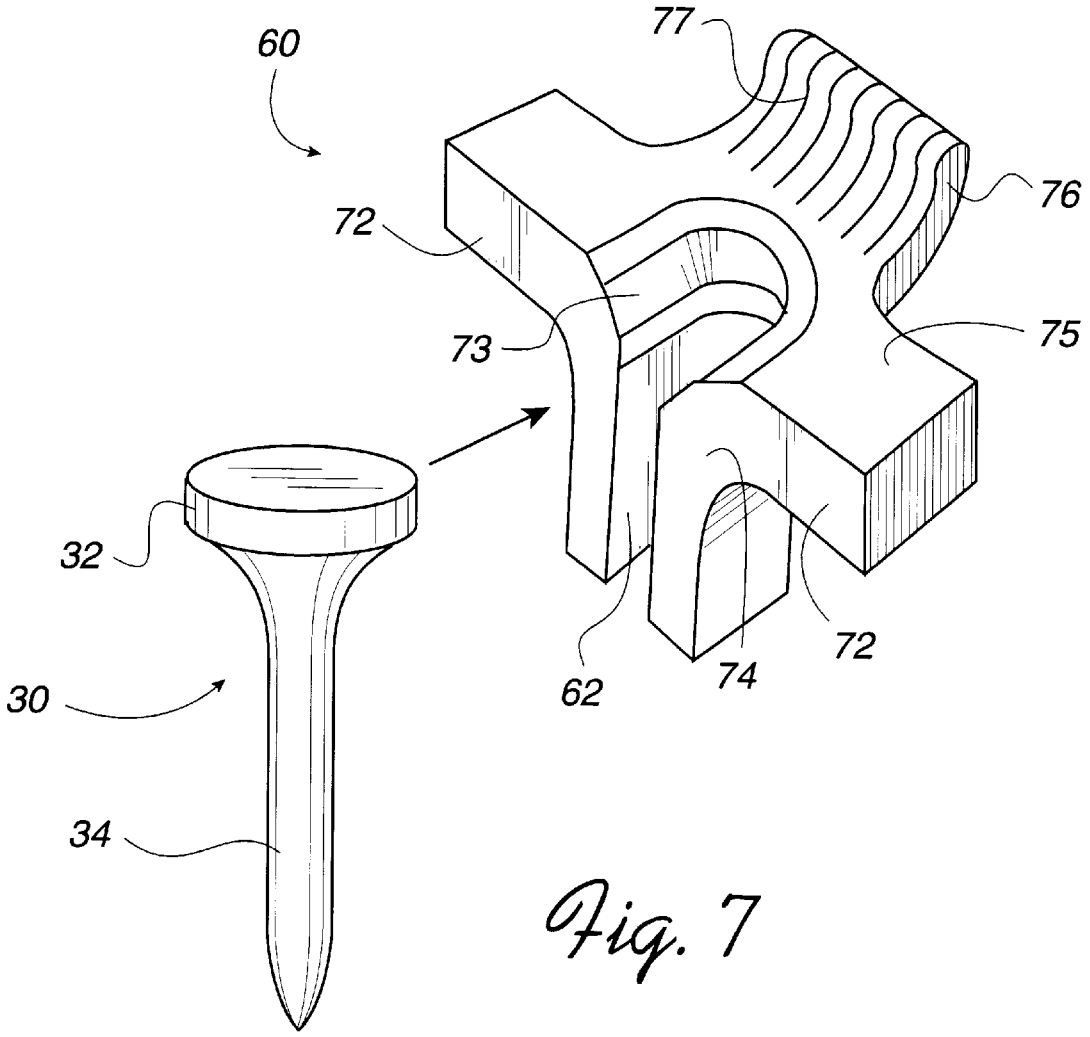
FIG. 7 illustrates a perspective view of a third embodiment of the golf tee setting device.

FIG. 7 illustrates a perspective view of a third embodiment of the golf tee setting device 60. The golf tee setting device 60 preferably has a handle 72 which is near the top portion and a body 74 having a receptacle 62, respectively, for receiving a golf tee 30. The golf tee 30 in a through opening extending along the height of the body is described in detail with respect to the first embodiment of the present invention in FIG. 1. The receptacle 62 is configured to the shape of the head portion 32 of the golf tee 30. The golf tee setting device 60 also has a collar 76 extending from the rear of and upwardly from the body 74 to support a golf ball. The collar 76 may include a plurality of grooves 77 to prevent the golf ball from sliding sideways.

In the third embodiment, the top of the receptacle 62 is exposed, unlike the first embodiment, so that the head 32 of the golf tee 30 can directly receive a golf ball. The distance between the top portion 75 of the golf tee setting device 60 and the bottom portion, which makes contact with the ground surface, determines the projection height of the golf tee.

Figure 8:
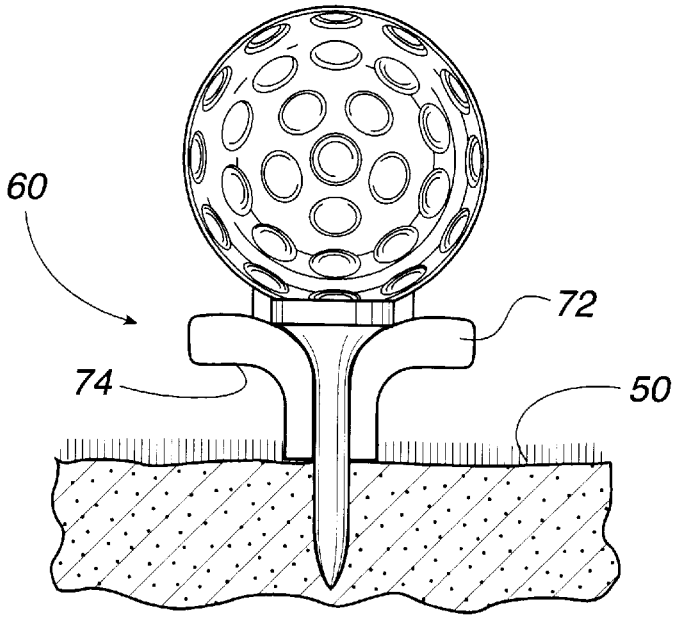
FIG. 8 illustrates a front elevation view of the golf tee setting device of FIG. 7.

FIG. 8 is a front elevation view of the third embodiment. The handle 72 of the golf tee setting device 60 extends outwardly from the body 24 to facilitate the insertion of the golf tee 30 into a ground surface 50. The size of the semi-cylindrical aperture 73 (shown in FIG. 7) is preferably slightly larger than the head portion 32 of the golf tee 30. The receptacle 62 is configured to be slightly larger than the tapering section of the golf tee 30 which connects the head portion 32 and the middle portion 34 of the golf tee 30.

Figure 9:
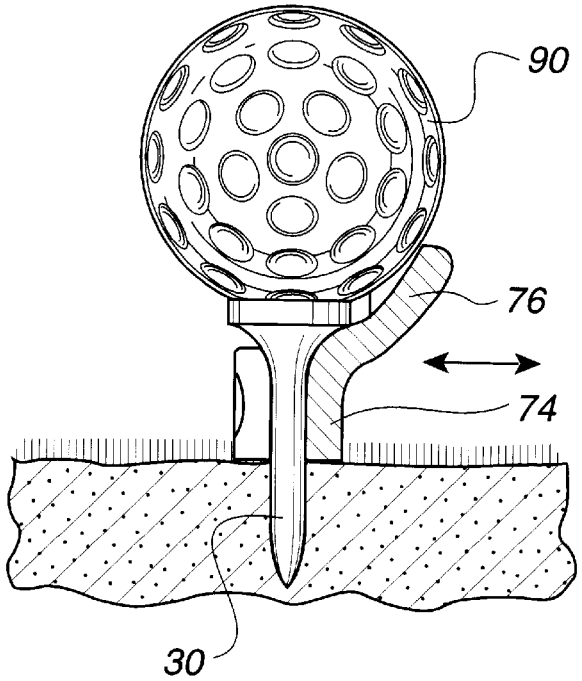
FIG. 9 illustrates a cross-sectional side elevation view of the golf tee setting device of FIG. 7.

FIG. 9 illustrates a cross-sectional elevation view of the golf tee setting device 60 with the position of the golf tee 30. As shown, the receptacle 62 is used for setting the height of golf tee 30 with respect to the ground surface. A golf ball 90 is placed so that the bottom of the golf ball 90 is in contact with the top of the golf tee 30, and the side of the golf ball 90 is in contact with the collar 76.

The application of the third embodiment will now be described. First a golf tee 30 is placed into a receptacle 62. Due to the shape of the receptacle 62, the golf tee 30 will be removably placed into the receptacle 62. A golf ball 90 is then placed on the top of the golf tee 30, the golf ball 90 being rested against the collar 76. Then a golfer grabs the handle 72 and perpendicularly forces the lower part of the golf tee 30 into a ground surface 50. When the lower portion of the golf tee setting device 60 abuts against the ground surface 50, the golf tee 30 is positioned substantially perpendicular to the ground surface 50 at a predetermined height. At the same time, the golf ball 90 is already placed on the golf tee 30. The golf tee setting device 60 is then removed by sliding it side way thus fully exposing the golf tee 30.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf tee setting device for adjustably positioning a golf tee into a ground surface and placing a golf ball, the golf tee setting device comprising:

a body made of a rigid material, wherein a height of the body defines a predetermined height of the golf tee with respect to the ground surface;

a receptacle having a through opening extending along the height of the body for positioning the golf tee, the length of the receptacle determining a separation distance of the golf ball from the ground surface, wherein the receptacle has a bottom end and a top end which are exposed, the top end of the receptacle being configured to receive the golf ball, and length of the receptacle is shorter than a length of the golf tee so that a lower end of the golf tee is exposed from the body; and a collar projecting from the body, wherein the collar is designed to assist placement of the golf ball on the golf tee, the collar being made with a rigid material.

2. A golf tee setting device of claim 1, wherein the collar is projecting from a rear of and upwardly from the body for supporting the golf ball.

3. A golf tee setting device of claim 1, wherein the top end of the receptacle is wider than the bottom end.

4. A golf tee setting device of claim 1, further comprising a pair of handle oppositely disposed and extending from the body.

5. A golf tee setting device of claim 1, wherein the body and the collar are formed as a single piece construction.

6. A golf tee setting device of claim 5, wherein the body and the collar are made with plastic.

7. A golf tee setting device of claim 5, wherein the body and the collar are made with metal.

* * * * *